US009853382B2

(12) United States Patent
Nakano

(10) Patent No.: US 9,853,382 B2
(45) Date of Patent: Dec. 26, 2017

(54) CONNECTOR

(71) Applicant: DDK Ltd., Tokyo (JP)

(72) Inventor: Yuki Nakano, Tokyo (JP)

(73) Assignee: DDK LTD., Tokyo (JP)

( * ) Notice: Subject to any disclaimer, the term of this patent is extended or adjusted under 35 U.S.C. 154(b) by 78 days.

(21) Appl. No.: 14/464,371

(22) Filed: Aug. 20, 2014

(65) Prior Publication Data

US 2014/0357111 A1 Dec. 4, 2014

Related U.S. Application Data

(63) Continuation of application No. 13/354,157, filed on Jan. 19, 2012, now Pat. No. 8,840,411.

(30) Foreign Application Priority Data

Jan. 20, 2011 (JP) ..... 2011-009617

(51) Int. Cl.

| | |
|---|---|
| ***H01R 12/88*** | (2011.01) |
| ***H01R 12/78*** | (2011.01) |
| ***H01R 13/629*** | (2006.01) |
| ***H01R 12/79*** | (2011.01) |

(52) U.S. Cl.

CPC ..... *H01R 12/78* (2013.01); *H01R 12/79* (2013.01); *H01R 13/62933* (2013.01); *H01R 12/88* (2013.01)

(58) Field of Classification Search

CPC .. H01R 13/62933; H01R 12/88; H01R 12/78; H01R 12/79; H01R 13/62938

USPC ..... 439/260

See application file for complete search history.

(56) References Cited

U.S. PATENT DOCUMENTS

| | | | | |
|---|---|---|---|---|
| 7,892,002 | B2 * | 2/2011 | Shen | H01R 13/65802 439/260 |
| 8,840,411 | B2 * | 9/2014 | Nakano | H01R 12/79 439/260 |
| 2004/0023551 | A1 | 2/2004 | Suzuki et al. | |
| 2006/0105622 | A1 | 5/2006 | Nakano et al. | |
| 2012/0231646 | A1 | 9/2012 | Nakano | |

FOREIGN PATENT DOCUMENTS

| | | | |
|---|---|---|---|
| JP | 2004-071160 | A | 8/2002 |
| JP | 2005-141956 | A | 2/2005 |
| JP | 2006-134708 | A | 5/2006 |
| JP | 2006-147271 | A | 6/2006 |

* cited by examiner

*Primary Examiner* — Felix O Figueroa

(74) *Attorney, Agent, or Firm* — Knobbe, Martens, Olson & Bear, LLP

(57) ABSTRACT

It is the object of the present invention to provide a connector 10 which provides a stable connection that is resistant to the rocking motion of a connecting object in insertion direction, longitudinal pitch direction, or the direction of the thickness of the connector, while maintaining the low-profile level so as to prevent the deflection of the connecting object even when the connector is mounted on a flexible board e.g., an FPC.

15 Claims, 8 Drawing Sheets

FIG. 1A
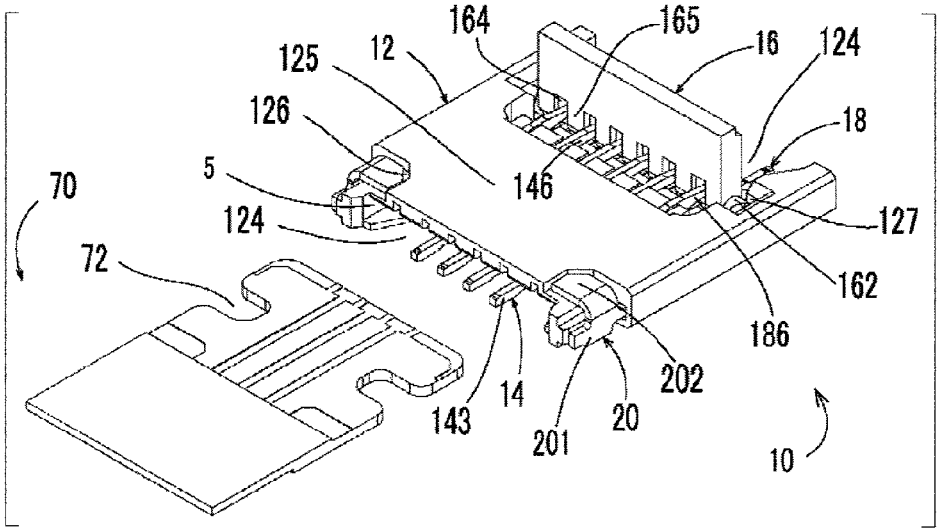
FIG. 1B
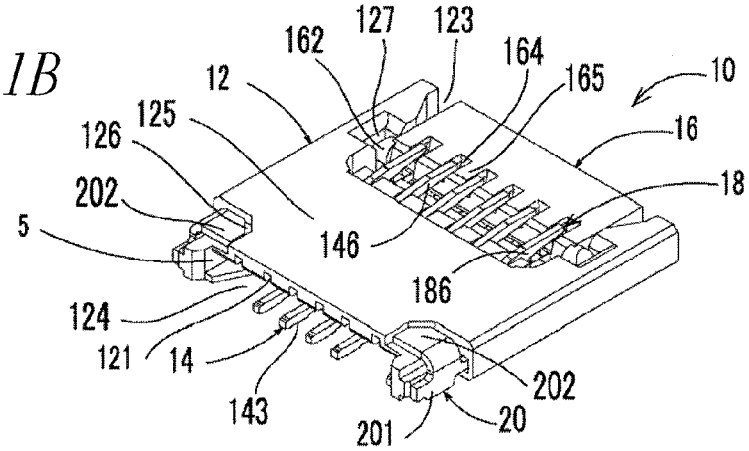
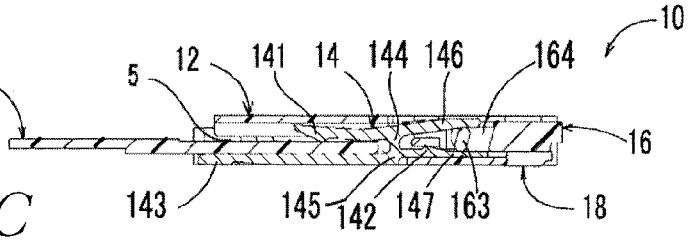
FIG. 1C
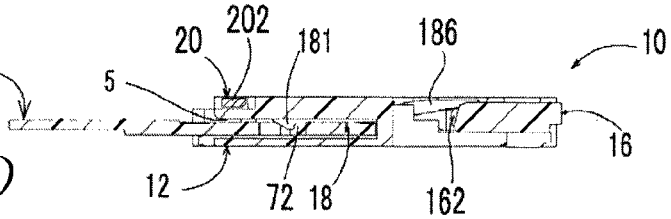
FIG. 1D

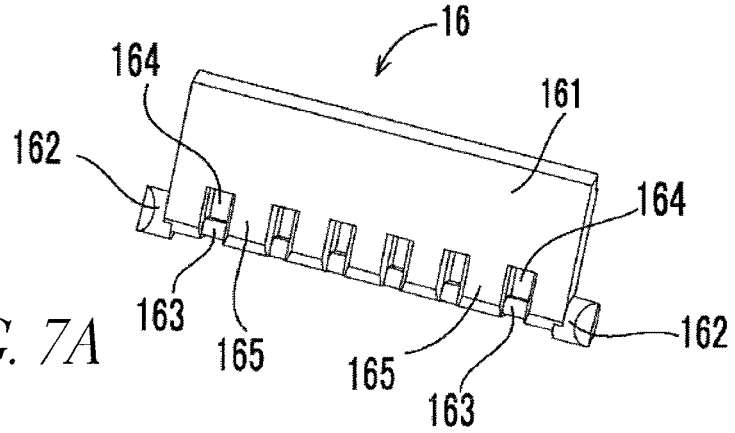
FIG. 7A
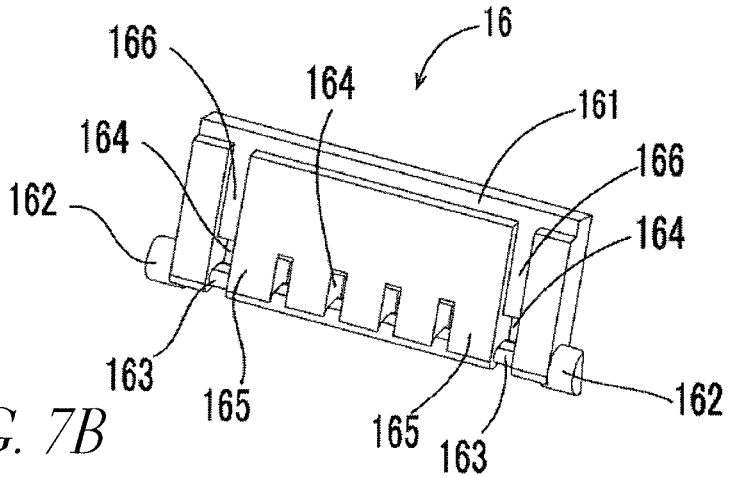
FIG. 7B
FIG. 7C
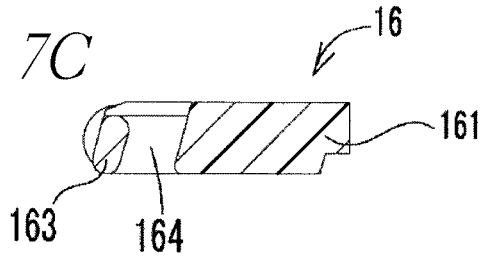
FIG. 7D
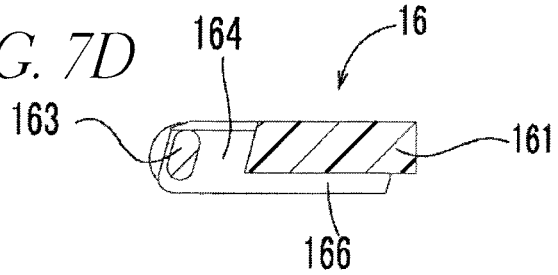

CONNECTOR

CROSS-REFERENCE TO RELATED APPLICATION

This application is a continuation of U.S. patent application Ser. No. 13/354,157, entitled CONNECTOR, and filed Jan. 19, 2012.

BACKGROUND OF THE INVENTION

Technical Field

The present invention relates to a connector used for communication equipment, electric devices, or electronic appliances, such as mobile terminals, projectors, television sets, etc., and it relates particularly to measures against the rocking motion of a connecting object in insertion direction, longitudinal pitch direction or upward direction, which are realized with a simple structure designed to achieve a connector with reduced profile height.

Background Art

Typically, connectors for connecting a connecting object (flexible printed circuit board (hereinafter called "FPC"), flexible flat cable (hereinafter called "FFC"), thin coaxial cable, and the like) with the help of a pivoting member by rotating the pivoting member comprise at least a plurality of contacts, a housing, and a pivoting member. Connectors that rotate a pivoting member to connect a connecting object to contacts are roughly classified into two types: front-lock type connectors and back-lock type connectors. In front-lock type connectors the pivoting member is rotated on the connecting object insertion side, while in back-lock type connectors the pivoting member is rotated on the side opposite from where the connecting object is inserted. Herein, only a back-lock type connector is described.

Hereinafter, a front-lock type connector with fixtures, a back-lock type connector and a connector for achieving a low profile, the latter two having been proposed by the applicant, are exemplified.

A back-lock type connector proposed by the applicant is disclosed in Japanese Patent Application Publication No. 2004-71160 (Patent Document 1); a connector for achieving a low profile in Japanese Patent Application Publication No. 2005-141956 (Patent Document 2); and a back-lock type connector with locking members in Japanese Patent Application Publication No. 2006-147271 (Patent Document 3). A front-lock type connector with fixtures is disclosed in Japanese Patent Application Publication No. 2006-134708 (Patent Document 4).

[Patent Document 1]

According to the abstract of Patent Document 1, the invention has the object to provide a connector which is capable of securely pressing an FPC 40 or FFC onto contact portions 22 of contacts 14 by means of a slider 16 without the strength, specifications, etc. of respective members degrading, and of achieving excellent operability, narrower pitches, and reduction in profile height. For the reduction in profile height, this connector comprises elastic portions 34 and fulcrum portions 32 between the contact portions 22 and connection portions 24 of the contacts 14, the contact portions 22, the elastic portions 34, the fulcrum portions 32, and the connection portions 24 being arranged roughly in the form of a crank. Further, pressure receiving portions 20 extending from the elastic portions 34 are provided on positions opposite the connection portions 24, while pressing portions 36 are provided longitudinally parallel to the slider 16. The slider 16 is mounted to the housing 12 in such a way that the pressing portions 36 are pivotable between the connection portions 22 and the pressure receiving portions 20 of the contacts 14. With this configuration, the above object can be achieved.

[Patent Document 2]

According to the abstract of Patent Document 2, the invention has the object to provide a low-profile connector 20 with a configuration that makes a height of approximately 0.6 mm possible. This low-profile connector 20, into which an FPC 10 or FFC can be plugged or from which an FPC 10 or FFC can be pulled, comprises a plurality of contacts 24 having contact portions 32 which are brought into contact with the FPC 10 or FFC, and a housing 22 in which these contacts 24 are held/arranged and that has a fitting portion 30 into which the FPC 10 or FFC is inserted. The contacts 24 protrude from the housing 22 and are arranged parallel to a hard board 46 or the FPC. The contacts 24 are provided with contact portions 32 on the hard board 46 or FPC side. At least the contact portions 32 or the parts protruding from the housing 22 are not covered by the housing 22. With this configuration, the low-profile connector 20 can achieve the above object.

[Patent Document 3]

According to the abstract of Patent Document 3, the invention has the object to provide a connector which is capable of having a further reduced profile height without causing connection failures, and which can ensure, even with a small number of pins, a stable holding force on an FPC. An FPC 80 is provided with anchoring portions 82, and locking members 18 are mounted on a housing 12. The locking members 18 comprise first pieces 20 having, on a first side, engaging portions 24 for engaging with the anchoring portions 82, on a second side, pressure receiving portions 26 pressed by a pivoting member 16, and protruding portions 34 protruding inward on the tips of the pressure receiving portions; second pieces 22 having, on the second side, connection portions 30 for connecting to a board; and connecting fulcrum portions 32 for connecting the first side of the first pieces 20 to the first side of the second pieces 22.

Thus, a connector is disclosed wherein, when the pivoting member 16 is rotated to engage the engaging portions 24 of the locking members 18 with the anchoring portions 82 of the FPC 80, the second pieces 22 are not present in positions opposite the engaging portions 24, and wherein the housing 12 is provided with recesses 42 in positions corresponding to the locking members 18.

[Patent Document 4]

According to the abstract of Patent Document 4, the invention has the object to firmly ground a shielding member of an FPC. Therefore, a connector for a flexible board is disclosed, wherein a housing 3 is provided with a plurality of signal contacts 11 and ground contacts 12a, 12b, the ground contacts 12a, 12b being integrally molded articles comprised of connection portions 61 that are directly connected to a ground connecting piece 24 connected to a shielding member 22 of an FPC 2, press-fit pieces that are press-fit into the housing 3, and fixed tabs 64 that are fixed on a printed wiring board 3 and connected to the ground.

SUMMARY

The present invention is made in view of the above conventional problems, and it is an object of the present invention to provide a connector that provides a stable connection that is resistant to the rocking motion of the connecting object in the insertion direction, the longitudinal pitch direction and the upward direction (the thickness direction of the connector) while providing further reduction in profile height or maintaining the current low-profile level so as to prevent the deflection, etc. of the connecting object even when the connector is mounted on a flexible board, e.g., an FPC.

BRIEF DESCRIPTION OF THE DRAWINGS

FIG. 1(A) is a perspective view of a connector and an FPC, viewed from above the fitting opening, with the pivoting member opened.

FIG. 1(B) is a perspective view of the connector, viewed from above the fitting opening, with the pivoting member closed.

FIG. 1(C) is a cross-sectional view of the connector, cut along a certain portion of the contact, with the pivoting member closed.

FIG. 1(D) is a cross-sectional view of the connector, cut along the fixture, with the pivoting member closed.

FIG. 7(A) is a perspective view of the pivoting member, viewed from the direction of the fitting opening.

FIG. 7(B) is a perspective view of the pivoting member, viewed from the opposite side of the fitting opening.

FIG. 7(C) is a cross-sectional view of the pivoting member, cut along a certain portion of the anchoring hole into which the pressure receiving portion of the contact is inserted.

FIG. 7(D) is a cross-sectional view of the pivoting member, cut along a certain portion of the anchoring hole into which the pressure receiving portion of the locking member is inserted.

DESCRIPTION OF REFERENCE NUMERALS

Figure 2A:
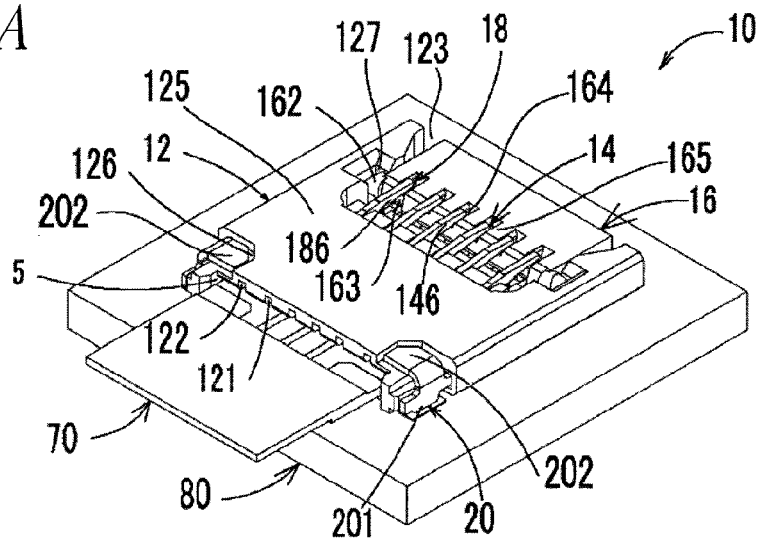
FIG. 2(A) is a perspective view of the connector mounted on the board, viewed from above the fitting opening, with the FPC inserted and the pivoting member closed.

5 Fitting opening
10 Connector
12 Housing
121 Insertion groove (for contact)
122 Insertion groove (for locking member)
123 First recess portion
124 Second recess portion
125 Roof portion
126 Groove
127 Bearing
14 Contact
141 First contact portion
142 First fixing portion
143 First connection portion
144 First elastic portion
145 First fulcrum portion
146 First pressure receiving portion
147 First extending portion
148 Recess portion
149 First protruding portion
16 Pivoting member
161 Operating portion
162 Shaft
163 Pressing portion
164 Anchoring hole
165 Partition wall
166 Recess
18 Locking member
181 Engaging portion
182 Fixing portion
183 Connection portion
184 Elastic portion
185 Fulcrum portion
186 Pressure receiving portion
20 Fixture
201 Connection portion
202 Engaging portion
203 Fixing portion
204 Extending portion
30 Lower end
32 Upper end
34 Rotation axis
70 FPC (flexible printed circuit board)
72 Anchoring portion
80 Board

DETAILED DESCRIPTION

Problems to be Solved by the Invention

In recent years, the miniaturization of communication equipment, electric devices, electronic appliances, etc. as well as the miniaturization of connectors has been in progress. Therefore, there is a need for a stable connection that is resistant to the rocking motion of a connecting object in insertion direction, longitudinal pitch direction or upward direction (the thickness direction of the connector) while providing further reduction in profile height or maintaining the current low-profile level. There is also a need for the deflection of the connecting object being prevented and a stable connection being obtained even when the connector is mounted on a flexible board, e.g., an FPC.

However, the aforementioned inventions have the following problems.

The structure in Patent Document 1 has no measure against the rocking motion of a connecting object in the insertion direction, the longitudinal pitch direction, or the upward direction (the thickness direction of the connector).

Since the structure in Patent Document 2 has no lower wall, it allows the profile of the connector to be reduced. However, it has no measure against the rocking motion of a connecting object in the insertion direction, the longitudinal pitch direction and the upward direction (the thickness direction of the connector). Further, when the connector is mounted on a flexible board, e.g., an FPC, the board on which the connector is mounted is easily deflected, and the deflection, etc. of the connecting object cannot be prevented due to the lack of the lower insulator wall.

The structure in Patent Document 3 uses locking members as a measure against the rocking motion of the connecting object in the insertion direction. However, it has no measure against the rocking motion in the longitudinal pitch direction and the upward direction (the thickness direction of the connector).

The structure in Patent Document 4 uses fixtures as a measure against the rocking motion in the longitudinal pitch direction and the upward direction (the thickness direction of the connector). However, it has no measure against the rocking motion of a connecting object in the insertion direction.

Means for Solving the Problems

The object of the present invention can be achieved by a connector for detachably plugging a connecting object, comprising a plurality of contacts, each having a contact portion for contacting the connecting object, and a pressure receiving portion subjected to the action of a pivoting member; a housing holding and arranging the contacts and having a fitting opening for inserting the connecting object; and the pivoting member being pivotally mounted on the side of the housing opposite from the fitting opening; wherein the connecting object is provided with anchoring portions; locking members, each of which has an engaging portion for engaging with one of the anchoring portions each; a connection portion for connecting to a board; an elastic portion and a fulcrum portion provided between the engaging portion and the connection portion; and a pressure receiving portion extending from the elastic portion in the direction opposite from that of the engaging portion, are arranged at either end in the longitudinal pitch direction; the housing is provided with a first recess portion that allows the pressure receiving portions of the contacts to be moved, a second recess portion on the lower side of the housing on the fitting opening side, and grooves on the upper side of the housing on the fitting opening side; fixtures, each of which has an engaging portion for engaging with one groove each and a connection portion for connecting to the board, are arranged on the fitting opening side; and each contact is at least provided with a first elastic portion and a first fulcrum portion provided between a first contact portion, which is the contact portion, and a first connection portion such that the first contact portion, the first elastic portion, the first fulcrum portion and the first connection portion are arranged roughly in a U-shape, and with a first pressure receiving portion, which is the pressure receiving portion, extending from the first elastic portion in the direction opposite from the first contact portion.

The connector can be a connector wherein the locking members provide a measure against the rocking motion of the connecting object in the insertion and removal direction, the engaging portions of the fixtures are engaged with the grooves of the housing to provide a measure against the rocking motion of the connecting object in the upward and pitch directions, and the first and second recess portions allow a reduction in the profile height of the connector.

Additionally, the connector can be a connector wherein the engaging portion, the elastic portion, the fulcrum portion and the connection portion of each locking member are arranged roughly in the form of a crank or roughly in a U-shape.

Further, the connector can be a connector wherein the engaging portion, the elastic portion, the fulcrum portion and the connection portion of each locking member are arranged roughly in the form of a crank and inserted into the housing on the side opposite from the fitting opening, the connection portions of the fixtures are arranged on the fitting opening side, and the connection portions of the locking members and the connection portions of the fixtures are arranged on the opposite side of each other.

The connector can be a connector wherein second contacts, each of which is provided with a second elastic portion and a second fulcrum portion provided between a second contact portion, which is the contact portion, and a second connection portion such that the second contact portion, the second elastic portion, the second fulcrum portion and the second connection portion are arranged roughly in the form of a crank, and with a second pressure receiving portion, which is the pressure receiving portion, extending from the second elastic portion in a position opposite the second connection portion, are inserted into the housing from the side opposite from the fitting opening, and wherein the contacts and the second contacts are arranged in an alternating manner.

The connector can be a connector wherein, when the connecting object is inserted into the fitting opening, the connecting object is inserted into the fitting opening in such a manner as to abut against the first connection portions of the contacts.

Furthermore, the connector can be a connector wherein the pivoting member is pivotally mounted on the side of the housing opposite from the fitting opening and provided with elongated pressing portions which are longitudinally provided parallel to the pivoting member such that each pressing portion acts on the first pressure receiving portion and/or the second pressure receiving portion and the pressure receiving portion of one locking member each, and further provided with separate individual anchoring holes with partition walls into each of which one of the first pressure receiving portions and/or one of the second pressure receiving portions and one of the pressure receiving portions are inserted such that when the pressing portion acts on the first pressure receiving portion and/or the second pressure receiving portion and the pressure receiving portion of the locking member, a connection and engagement with the connecting object is made.

Furthermore, the connector can be a connector wherein each extending portion of the contacts is provided with a recess that accommodates the thickness of the housing.

Advantages of the Invention

As is apparent from the foregoing explanation, the connector of the present invention provides the following advantageous effects.

(1) The connector can be a connector for detachably plugging a connecting object, comprising a plurality of contacts, each having a contact portion for contacting the connecting object, and a pressure receiving portion subjected to the action of a pivoting member; a housing holding and arranging the contacts and having a fitting opening for inserting the connecting object; and the pivoting member being pivotally mounted on the side of the housing opposite from the fitting opening; wherein the connecting object is provided with anchoring portions; locking members, each of which has an engaging portion for engaging with one of the anchoring portions each; a connection portion for connecting to a board; an elastic portion and a fulcrum portion provided between the engaging portion and the connection portion; and a pressure receiving portion extending from the elastic portion in the direction opposite from that of the engaging portion, are arranged at either end in the longitudinal pitch direction; the housing is provided with a first recess portion that allows the pressure receiving portions of the contacts to be moved, a second recess portion on the lower side of the housing on the fitting opening side, and grooves on the upper side of the housing on the fitting opening side; fixtures, each of which has an engaging portion for engaging with one groove each and a connection portion for connecting to the board, are arranged on the fitting opening side; and each contact is at least provided with a first elastic portion and a first fulcrum portion provided between a first contact portion, which is the contact portion, and a first connection portion such that the first contact portion, the first elastic portion, the first fulcrum portion and the first connection portion are arranged roughly in a U-shape, and with a first pressure receiving portion, which is the pressure receiving portion, extending from the first elastic portion in the direction opposite from the first contact portion. In this way, a stable connection that is resistant to the rocking motion of the connecting object in the insertion direction, the longitudinal pitch direction and the upward direction (the thickness direction of the connector) so as to prevent the deflection, etc. of the connecting object even when the connector is mounted on a flexible board, e.g., an FPC, can be obtained while maintaining a low-profile height of 0.5 mm or less.

(2) The connector can be a connector wherein the locking members provide a measure against the rocking motion of the connecting object in the insertion and removal direction, the engaging portions of the fixtures are engaged with the grooves of the housing to provide a measure against the rocking motion of the connecting object in the upward and pitch directions, and the first and second recess portions allow a reduction in the profile height of the connector. In this way, a stable connection that is resistant to the rocking motion of the connecting object in the insertion direction, the longitudinal pitch direction and the upward direction (the thickness direction of the connector) so as to prevent the deflection, etc. of the connecting object even when the connector is mounted on a flexible board, e.g., an FPC, can be obtained while maintaining a low-profile height of 0.5 mm or less.

(3) The connector can be a connector wherein the engaging portion, the elastic portion, the fulcrum portion and the connection portion of each locking member are arranged roughly in the form of a crank or roughly in a U-shape. In this way, a stable connection that is resistant to the rocking motion of the connecting object in the insertion direction, the longitudinal pitch direction and the upward direction (the thickness direction of the connector) so as to prevent the deflection, etc. of the connecting object even when the connector is mounted on a flexible board, e.g., an FPC, can be obtained while maintaining a low-profile height of 0.5 mm or less.

(4) The connector can be a connector wherein the engaging portion, the elastic portion, the fulcrum portion and the connection portion of each locking member are arranged roughly in the form of a crank and inserted into the housing on the side opposite from the fitting opening, the connection portions of the fixtures are arranged on the fitting opening side, and the connection portions of the locking members and the connection portions of the fixtures are arranged on the opposite side of each other. In this way, a stable connection that is resistant to the rocking motion of the connecting object in the insertion direction, the longitudinal pitch direction and the upward direction (the thickness direction of the connector) so as to prevent the deflection, etc. of the connecting object even when the connector is mounted on a flexible board, e.g., an FPC, can be obtained while maintaining a low-profile height of 0.5 mm or less. In addition, the connector is well balanced on the mounting board, and the mounting strength on the mounting board is stable as well.

(5) The connector can be a connector wherein second contacts, each of which is provided with a second elastic portion and a second fulcrum portion provided between a second contact portion, which is the contact portion, and a second connection portion such that the second contact portion, the second elastic portion, the second fulcrum portion and the second connection portion are arranged roughly in the form of a crank, and with a second pressure receiving portion, which is the pressure receiving portion, extending from the second elastic portion in a position opposite the second connection portion, are inserted into the housing from the side opposite from the fitting opening, and wherein the contacts and the second contacts are arranged in an alternating manner. In this way, a stable connection that is resistant to the rocking motion of the connecting object in the insertion direction, the longitudinal pitch direction and the upward direction (the thickness direction of the connector) so as to prevent the deflection, etc. of the connecting object even when the connector is mounted on a flexible board, e.g., an FPC, can be obtained while maintaining a low-profile height of 0.5 mm or less.

(6) The connector can be a connector wherein, when the connecting object is inserted into the fitting opening, the connecting object is inserted into the fitting opening in such a manner as to abut against the first connection portions of the contacts. In this way, a stable connection that is resistant to the rocking motion of the connecting object in the insertion direction, the longitudinal pitch direction and the upward direction (the thickness direction of the connector) so as to prevent the deflection, etc. of the connecting object even when the connector is mounted on a flexible board, e.g., an FPC, can be obtained while maintaining a low-profile height of 0.5 mm or less.

(7) The connector can be a connector wherein the pivoting member is pivotally mounted on the side of the housing opposite from the fitting opening and provided with elongated pressing portions which are longitudinally provided parallel to the pivoting member such that each pressing portion acts on the first pressure receiving portion and/or the second pressure receiving portion and the pressure receiving portion of one locking member each, and further provided with separate individual anchoring holes with partition walls into each of which one of the first pressure receiving portions and/or one of the second pressure receiving portions and one of the pressure receiving portions are inserted such that when the pressing portion acts on the first pressure receiving portion and/or the second pressure receiving portion and the pressure receiving portion of the locking member, a connection and engagement with the connecting object is made. In this way, a stable connection that is resistant to the rocking motion of the connecting object in the insertion direction, the longitudinal pitch direction and the upward direction (the thickness direction of the connector) so as to prevent the deflection, etc. of the connecting object even when the connector is mounted on a flexible board, e.g., an FPC, can be obtained while maintaining a low-profile height of 0.5 mm or less.

(8) The connector can be a connector wherein each extending portion of the contacts is provided with a recess that accommodates the thickness of the housing. In this way, a stable connection that is resistant to the rocking motion of the connecting object in the insertion direction, the longitudinal pitch direction and the upward direction (the thickness direction of the connector) so as to prevent the deflection, etc. of the connecting object even when the connector is mounted on a flexible board, e.g., an FPC, can be obtained while maintaining a low-profile height of 0.5 mm or less.

The object of the present invention can be achieved by a connector comprising a plurality of contacts 14, a housing 12, locking members 18, and a pivoting member 16, wherein fixtures 20 are arranged to reinforce a roof portion 125 of the housing 12 as a measure against the rocking motion in the thickness and longitudinal directions, the locking members 18 are engaged with the connecting object as a measure against the rocking motion in the insertion direction, the housing 12 is provided with a first recess portion 123 and a second recess portion 124 for reduction in the profile height of the connector 10, and first connection portions 143 of the contacts 14 are arranged in the second recess portion 124, such that the deflection, etc. of the connecting object is prevented when the connector 10 is mounted on a flexible board 80, e.g., an FPC 70.

DETAILED DESCRIPTION

A feature of the present invention is a connector 10 for detachably plugging a connecting object, comprising a plurality of contacts 14, each having a contact portion for contacting the connecting object, and a pressure receiving portion subjected to the action of a pivoting member 16; a housing 12 holding and arranging the contacts 14 and having a fitting opening 5 for inserting the connecting object; and the pivoting member 16 being pivotally mounted on the side of the housing 12 opposite from the fitting opening 5; wherein the connecting object is provided with anchoring portions 72; locking members 18, each of which has an engaging portion 181 for engaging with one of the anchoring portions 72 each; a connection portion 183 for connecting to a board 80; an elastic portion 184 and a fulcrum portion 185 provided between the engaging portion 181 and the connection portion 183; and a pressure receiving portion 186 extending from the elastic portion 184 in the direction opposite from that of the engaging portion 181, are arranged at either end in the longitudinal pitch direction; the housing 12 is provided with a first recess portion 123 that allows the pressure receiving portions of the contacts 14 to be moved, a second recess portion 124 on the lower side of the housing on the fitting opening 5 side, and grooves 126 on the upper side of the housing on the fitting opening 5 side; fixtures 20, each of which has an engaging portion 202 for engaging with one groove 126 each and a connection portion 201 for connecting to the board 80, are arranged on the fitting opening 5 side; and each contact 14 is at least provided with a first elastic portion 144 and a first fulcrum portion 145 provided between a first contact portion 141, which is the contact portion, and a first connection portion 143 such that the first contact portion 141, the first elastic portion 144, the first fulcrum portion 145 and the first connection portion 143 are arranged roughly in a U-shape, and with a first pressure receiving portion 146, which is the pressure receiving portion, extending from the first elastic portion 144 in the direction opposite from the first contact portion 141.

In other words, the fixtures 20 are arranged to reinforce the roof portion 125 of the housing 12 as a measure against the rocking motion in the upward and longitudinal pitch directions, the locking members 18 are engaged with the connecting object as a measure against the rocking motion in the insertion direction, the housing 12 is provided with the first recess portion 123 and the second recess portion 124 to allow a reduction in profile height of the connector 10, and the first connection portions 143 of the contacts 14 are arranged in the second recess portion 124, so that the deflection, etc. of the connecting object is prevented even when the connector 10 is mounted on the flexible board 80, e.g., an FPC 70.

Figure 2B:
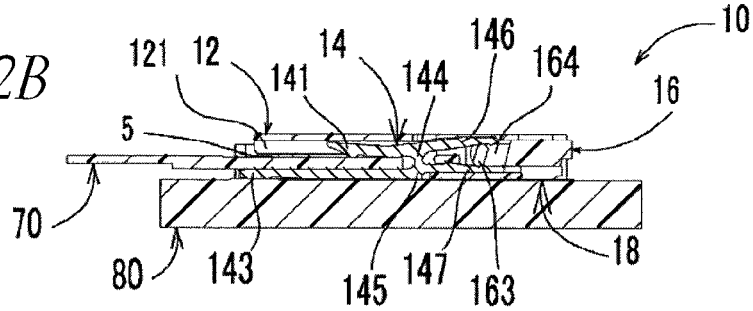
FIG. 2(B) is a cross-sectional view of the connector in the state of FIG. 2(A), cut along a certain portion of the contact.
Figure 2C:
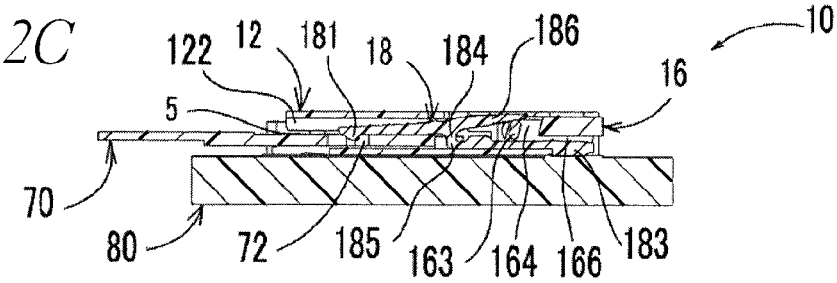
FIG. 2(C) is a cross-sectional view of the connector in the state of FIG. 2(A), cut along the locking member.
Figure 2D:
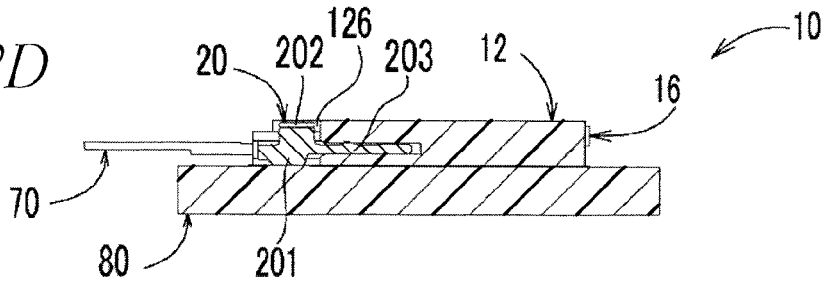
FIG. 2(D) is a cross-sectional view of the connector in the state of FIG. 2(A), cut along the fixture.
Figure 3:
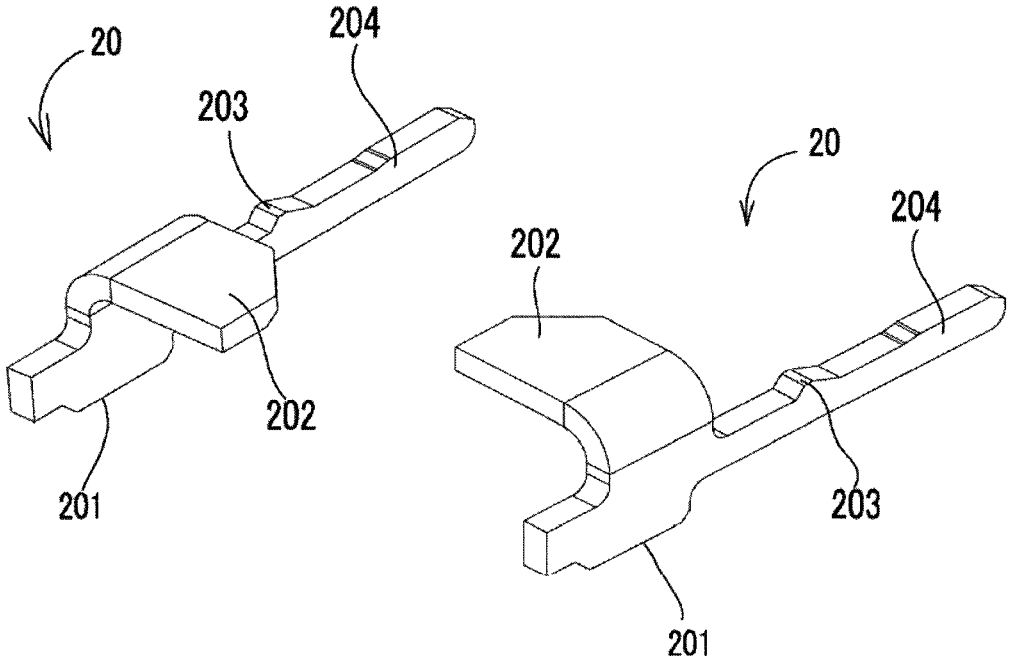
FIG. 3 is a perspective view of the fixtures at the left and right ends in the longitudinal pitch direction.
Figure 4:
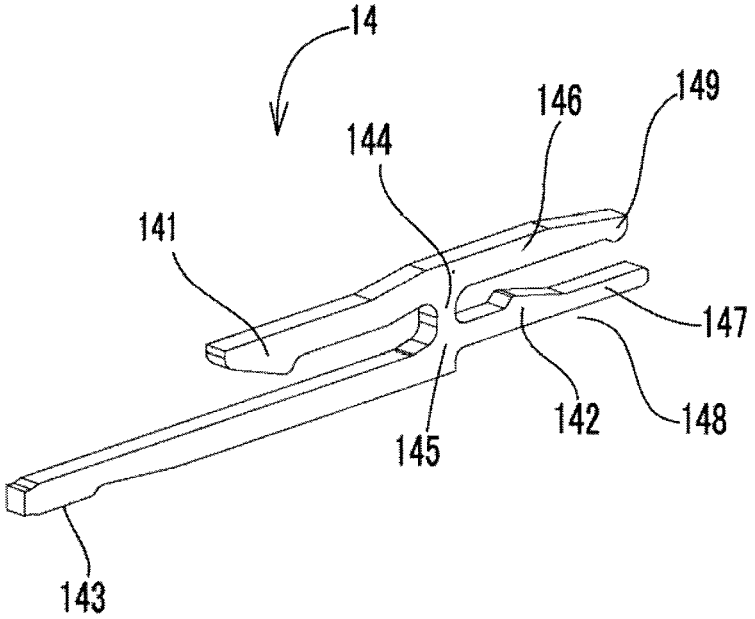
FIG. 4 is a perspective view of the contact.
Figure 5:
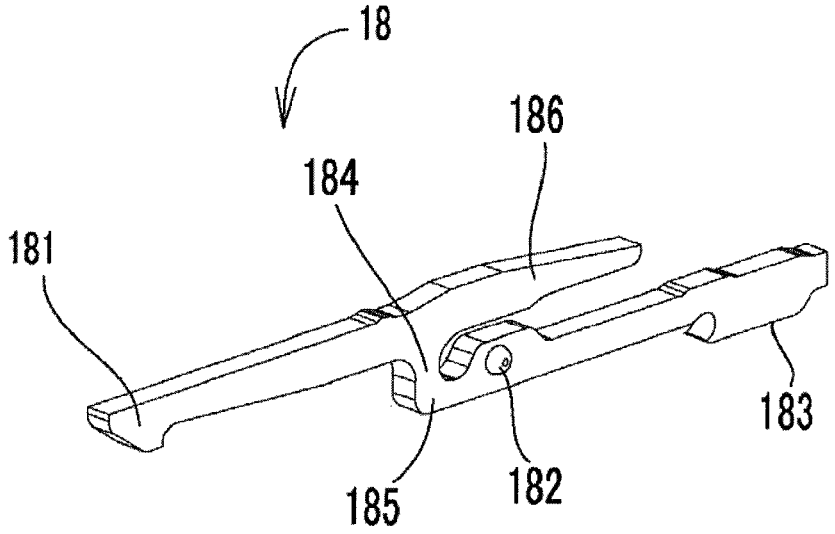
FIG. 5 is a perspective view of the locking member.
Figure 6A:
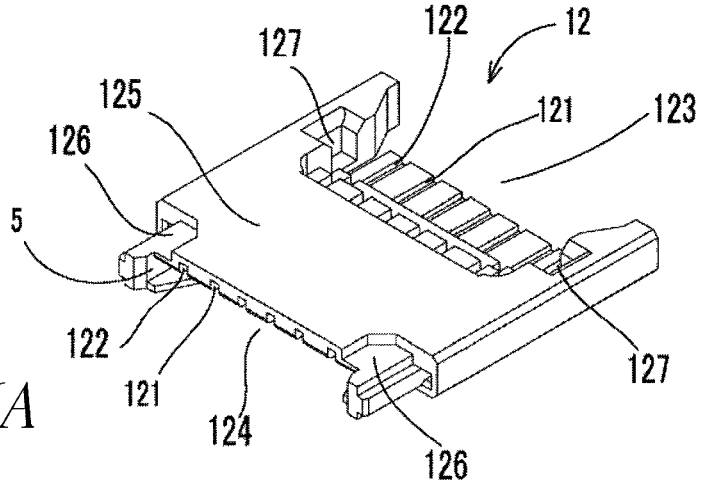
FIG. 6(A) is a perspective view of the housing, viewed from above the fitting opening.
Figure 6B:
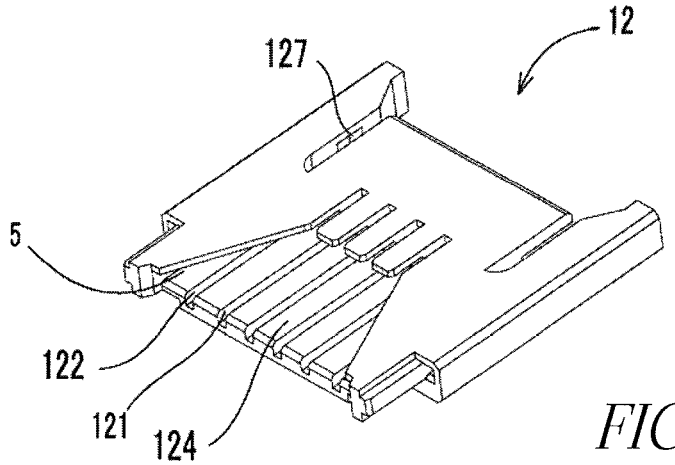
FIG. 6(B) is a perspective view of the housing turned upside down, viewed from above the fitting opening.
Figure 6C:
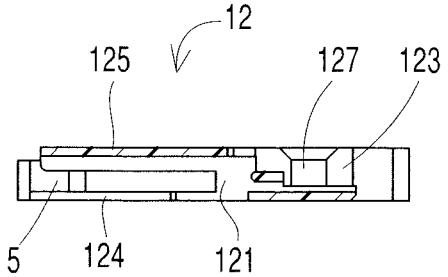
FIG. 6(C) is a cross-sectional view of the housing, cut along a certain portion of the insertion hole for the contact.
Figure 6D:
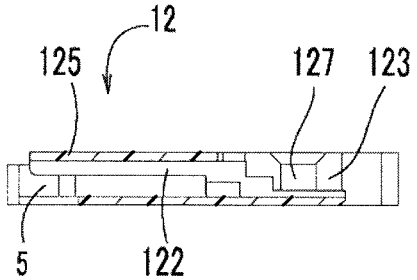
FIG. 6(D) is a cross-sectional view of the housing, cut along a certain portion of the insertion hole for the locking member.

FIG. 1(A) is a perspective view of the connector and the FPC, viewed from above the fitting opening, with the pivoting member opened; FIG. 1(B) is a perspective view of the connector, viewed from above the fitting opening, with the pivoting member closed; FIG. 1(C) is a cross-sectional view of the connector, cut along a certain portion of the contact, with the pivoting member closed; and FIG. 1(D) is a cross-sectional view of the connector, cut along the fixture, with the pivoting member closed. FIG. 2(A) is a perspective view of the connector mounted on the board, viewed from above the fitting opening, with the FPC inserted and the pivoting member closed; FIG. 2(B) is a cross-sectional view of the connector in the state of FIG. 2(A), cut along a certain portion of the contact; FIG. 2(C) is a cross-sectional view of the connector in the state of FIG. 2(A), cut along the locking member; and FIG. 2(D) is a cross-sectional view of the connector in the state of FIG. 2(A), cut along the fixture. FIG. 3 is a perspective view of the fixtures at the left and right ends in the longitudinal pitch direction. FIG. 4 is a perspective view of the contact; and FIG. 5 is a perspective view of the locking member. FIG. 6(A) is a perspective view of the housing, viewed from above the fitting opening; FIG. 6(B) is a perspective view of the housing turned upside down, viewed from above the fitting opening; FIG. 6(C) is a cross-sectional view of the housing, cut along a certain portion of the insertion hole for the contact; and FIG. 6(D) is a cross-sectional view of the housing, cut along a certain portion of the insertion hole for the locking member. FIG. 7(A) is a perspective view of the pivoting member, viewed from the direction of the fitting opening; FIG. 7(B) is a perspective view of the pivoting member, viewed from the opposite side of the fitting opening; FIG. 7(C) is a cross-sectional view of the pivoting member, cut along a certain portion of the anchoring hole into which the pressure receiving portion of the contact is inserted; and FIG. 7(D) is a cross-sectional view of the pivoting member, cut along a certain portion of the anchoring hole into which the pressure receiving portion of the locking member is inserted. FIGS. 8(A) to (E) are explanatory views of the motions of the pressing portion and the rotation axis during the rotation of the pivoting member; and FIG. 8(F) is an explanatory view of the profile-height-reducing effect when the rotation axis (dent) is not provided in the contact.

The connector 10 of the present embodiment comprises the plurality of contacts (contacts 14), the housing 12, the pivoting member 16, the locking members 18, and the fixtures 20.

First, the connecting object to be inserted into the fitting opening 5 of the connector 10 is described, followed by an explanation of the connector 10 of the present invention. Examples of the connecting object include the FPC 70, FFC, thin coaxial cable, etc. The present embodiment explains the case where the FPC 70 is used. The FPC 70 comprises at least a contact portion for contacting the first contact portions 141 of the contacts 14, a pattern leading from the contact portion to the circuit, and anchoring portions 72 for engaging with the engaging portions 181 of the locking members 18. In the present embodiment, the FPC 70 is provided with the contact portion only on its top surface. However, depending on, for example, the requests of the customer, the contact portion may be provided on both the top and the bottom surfaces. The anchoring portions 72 may be of any shape as long as they can be engaged with the engaging portions 181 of the locking members 18. In the present embodiment, the anchoring portions 72 may be U-shaped recesses, as shown in FIG. 1(A), or through-holes. The through-holes may be blind holes, depending on the specifications.

Next, the board 80 on which the connector 10 is mounted is described. The board 80 includes a hard board or FPC (flexible printed circuit board). Here, the description is given using the example of the hard board 80. The board 80 comprises at least a land to be connected to the first connection portions 143 of the contacts 14, and a pattern leading from the land to the circuit.

Hereinafter, the components of the connector 10 of the present invention are described with reference to the drawings.

First, the fixtures 20 are described. The fixtures 20 are made of metal and manufactured by a widely known pressing technique. Examples of the material of the fixtures 20, which is required to have springiness, moldability, etc., include brass, beryllium copper, phosphor bronze, etc.

The fixtures 20 are arranged to reinforce the housing 12 as a measure against the rocking motion of the connecting object in the upward direction (the thickness direction of the connector 10). The fixtures 20 have at least the connection portions 201 for connecting to the board 80 and the engaging portions 202 for engaging with the grooves 126 of the housing 12. In the present embodiment, the connection portions 201 and the engaging portions 202 are arranged roughly in an L-shape. Taking into account the measures against the rocking motion of the FPC 70, which is the connecting object, in the upward direction, the connection portions 201 are preferably arranged at the closest possible location to the engaging portions 202 since the strength against the upward rocking motion is greater when the connection portions 201 mounted on the board 80 are close to the engaging portions 202. The shape/size and location of the engaging portions 202 are properly designed in consideration of these measures against rocking motion, the mounting strength, workability, etc. In the present embodiment, the connection portions 201 are of a surface mount (SMT) type in consideration of the mounting density, etc., but may also be of a DIP type.

In the present embodiment, the two fixtures 20 are symmetrically arranged at either end of the housing 12 in the longitudinal pitch direction. However, a fixture 20 the engaging portions 202 of which are connected and which is therefore formed as one piece may also be used, as long as the rocking motion measures described above are realized. Of course, in case the fixture 20 which is formed in one piece is used, the grooves 126 at either end of the housing 12 in the longitudinal pitch direction are also connected.

In the present embodiment, the fixtures 20 are provided with extending portions 204 extending from the vicinity of the connection portions 201, and the extending portions 204 are provided with fixing portions 203 for fixing the fixtures 20 to the housing 12. The fixing portions 203 may be at any location as long as they can fix the fixtures 20 to the housing 12. If the fixtures 20 have arrow-head members press-fitted onto either side of the connection portion 201, the extending portions 204 are not necessary.

The connection portions 201 of the fixtures 20 are positioned in consideration of the mounting strength on the board 80 and the balance with the locking members 18. Taking into account the measures against the rocking motion of the FPC 70 in the upward direction and the mounting strength in a fine balance with the board 80, the connection portions 201 are preferably provided on the fitting opening 5 side of the housing 12.

Next, the contacts 14 are described. The contacts 14 are made of metal and manufactured by a widely known pressing technique. Examples of the material of the contacts 14, which is required to have springiness, conductivity, etc., include brass, beryllium copper, phosphor bronze, etc.

In the present embodiment, the contacts 14, as shown in FIG. 4, have roughly a transverse H-shape. The contacts 14 comprise at least the first contact portions 141 for contacting the FPC 70, FFC, or the like; the first connection portions 143 for connecting to the board 80; the first fixing portions 142 for fixing to the housing 12; the first elastic portions 144 and the first fulcrum portions 145 provided between the first contact portions 141 and the first connection portions 143; and the first pressure receiving portions 146 extending from the first elastic portions 144 in the direction opposite from the first contact portions 141. In the present embodiment, the contacts 14 further comprise first extending portions 147 extending from the first fulcrum portions 145 in such a manner as to face the first pressure receiving portions 146; and the recess portions 148 cut into the sides of the extending portions 147 facing the board 80. Depending on the specifications of the FPC 70, FFC, or the like, additional contact portions may be provided between the first fulcrum portions 145 and the first connection portions 143 in positions opposite the first contact portions 141 so as to be in contact with the FPC 70 or FFC. In this case, the two upper and lower contact portions, i.e., the two first contact portions 141, are provided so as to sandwich the FPC, FFC, or the like, which allows firm contact with the FPC 70, FFC, or the like. The upper first contact portions 141 (upper side in FIG. 4), the first elastic portions 144, the first fulcrum portions 145, and the first connection portions 143 are arranged roughly in a U-shape. The first contact portions 141 have a convex shape for easy contact with the FPC 70, FFC, or the like. In the present embodiment, as shown in FIGS. 1 and 4, the first connection portions 143 are of a surface mount (SMT) type, but may also be of a DIP type. In other words, the first connection portions 143 of the contacts 14 are arranged in the second recess portion 124 of the housing 12. By the first connection portions 143 being arranged in the second recess portion 124, the FPC 70 can be prevented from deflecting when the connector 10 is mounted on the flexible board 80, e.g., the FPC.

When the FPC 70, FFC, or the like is inserted, the first fulcrum portions 145, the first elastic portions 144, and the first pressure receiving portions 146 exert the following effects. When the pressing portions 163 of the pivoting member 16 are rotated to act on the first pressure receiving portions 146 of the contacts 14 after the FPC 70 or FFC is inserted into the fitting opening 5 of the housing 12, the first pressure receiving portions 146 are raised by the pressing portions 163. Then, using the first fulcrum portions 145 of the contacts 14 as a fulcrum, the first elastic portions 144 of the contacts 14 tilt toward the first contact portions 141 so that the first contact portions 141 are pressed onto the FPC 70 or FFC. The sizes and shapes of the first fulcrum portions 145, the first elastic portions 144, and the first pressure receiving portions 146 are properly designed to exert the above effects.

In the present embodiment, the contacts 14 further comprise the first extending portions 147 extending from the first fulcrum portions 145 so as to face the first pressure receiving portions 146; and the recess portions 148 cut into the first extending portions 147 on the side facing the board 80. In the present embodiment, the first fixing portions 142 are provided on the extending portions 147 as shown in FIG. 4. The first fixing portions 142 may be at any location as long as they can be fixed to the housing 12 and a sufficient holding strength on the housing 12 is provided. Therefore, the first extending portions 147 do not necessarily have to be provided. Even if provided, the length of the extending portions 147 may be shorter than that in the present embodiment and end at the first fixing portions 142.

The recess portions 148 of the contacts 14 accommodate the thick part of the housing 12 to allow a reduction in profile height. The size/shape of the recess portions 148 is properly designed in consideration of such role, reduction in profile height of the connector, thickness of the housing 12, workability, strength, etc.

Further, it is preferable that the ends of the first pressure receiving portions 146 of the contacts 14 are provided with first protruding portions 149 to prevent the center part of the pivoting member 16 from bulging due to a strong repulsion force working against the rotation of the pivoting member 16 when the pressure receiving portions 163 of the pivoting member 16 are rotated to act on the pressure receiving portions 146 of the contacts 14. The first protruding portions 149 may be of any size as long as this role is served, and they are properly designed so as to catch the pressing portions 163 of the pivoting member 16.

Next, the locking members 18 are described. The locking members 18 are made of metal and manufactured by a widely known pressing technique. Examples of the material of the locking members 18, which is required to have springiness, conductivity, etc., include brass, beryllium copper, phosphor bronze, etc.

In the present embodiment, the locking members 18, as shown in FIG. 5, have roughly a transverse h-shape. The locking members 18 comprise at least, at one end, the engaging portions 181 for engaging with the anchoring portion 72 of the FPC 70; the connection portions 183 for connecting to the board 80; the fixing portions 182 for fixing to the housing 12; the elastic portions 184 and the fulcrum portions 185 provided between the engaging portions 181 and the connection portions 183; and the pressure receiving portions 186 extending from the elastic portions 184 in the direction opposite from the engaging portions 181.

In the present embodiment, the engaging portions 181, the elastic portions 184, the fulcrum portions 185, and the connection portions 183 are arranged roughly in the form of a crank. In the present embodiment, the connection portions 183 are of a surface mount (SMT) type, but may also be of a DIP type. In the present embodiment, the connection portions 183 are arranged on the side of the housing 12 opposite from the fitting opening 5. In other words, they are arranged on the side of the housing 12 opposite from the connection portions 201 of the fixtures 20 to balance the mounting strength on the board.

When the FPC 70 is inserted, the elastic portions 184, the fulcrum portions 185, and the pressure receiving portions 186 function as a so-called ZIF structure to which no insertion force is applied. When the FPC 70 is inserted into the fitting opening 5 of the housing 12, the pivoting member 16 is in open state. After the FPC 70 is inserted, the pressing portions 163 of the pivoting member 16 are tilted, as shown in FIG. 2(B), between the pressure receiving portions 186 and the connection portions 183 of the locking members 18. When the pressure receiving portions 186 are raised (upward direction in the drawings) by the pressing portions 163, the elastic portions 184 of the locking members 18 tilt toward the engaging portions 181, using the fulcrum portions 185 of the locking members 18 as a fulcrum. Thus, the engaging portions 183 are pressed down to engage with the anchoring portions 72 of the FPC 70 inserted in the fitting opening 5 of the housing 12. The sizes and shapes of the elastic portions 184, the fulcrum portions 185, and the pressure receiving portions 186 are properly designed to exert the above effects.

The engaging portions 181 of the locking members 18 are provided in positions corresponding to the anchoring portions 72 of the FPC 70, and the locking members 18 are fixed to the housing 12 by means of press-fitting, engagement (lance), or the like to engage the engaging portions 181 with the anchoring portions 72. The size of the engaging portions 181 is properly designed to meet a required holding force, and the engaging portions 181 may be of any shape as long as they can be engaged with the anchoring portions 72 of the FPC 70. In the present embodiment, taking into account the holding force, etc., the engaging portions 181 are formed roughly into a right triangle shape so that vertical faces thereof come into contact with faces of the anchoring portions 72 of the FPC 70.

In the present embodiment, the locking members 18 have roughly a transverse h-shape. However, the locking members 18 may be provided with extending portions (not shown) extending from the fulcrum portions 185 in the direction opposite from the engaging portions 181. However, in consideration of engageability, the length to the end of the engaging portions 181 and the relation to the length of the extending portions are properly designed so that the extending portions are shorter than the engaging portions 181 such that when the locking members 18 are engaged with the FPC 70, the engaging portions 181 do not come into contact with the extending portions, and that a sufficient movement of the engaging portions 181 is ensured.

The fixing portions 182 are only required to be fixed to the housing 12. In the present embodiment, the fixing portions 182 are provided in the vicinity of the fulcrum portions 185 between the fulcrum portions 185 and the connection portions 183. The location of the fixing portions 182 is properly designed in consideration of the holding force, the reduction in profile height, strength, workability, etc. In the present embodiment, being fixed by press-fitting, the fixing portions 182 are provided with convex portions, as shown in FIG. 5, of a size that is matched to the holding force on the housing 12, etc.

Further, the ends of the pressure receiving portions 186 of the locking members 18 may be provided with protruding portions to prevent the center part of the pivoting member 16 from bulging due to it resisting against a strong repulsion force working against the rotation of the pivoting member 16. The protruding portions are preferably provided at either the contacts 14 or the locking members 18 or at all of them.

Next, the housing 12 is described. The housing 12 is electrically insulating plastic and it is manufactured by a widely known injection molding technique. The material thereof is properly selected in consideration of dimensional stability, workability, cost, etc., and examples thereof typically include polybutylene terephthalate (PBT), polyamides (66PA, 46PA), liquid crystal polymers (LCP), polycarbonates (PC), synthetic materials thereof, etc.

The housing 12 is provided with insertion grooves 121, 122 into which a required number of contacts 14 and locking members 18 is mounted and fixed by means of press-fitting, engagement (lance), welding, or the like. In the present embodiment, the insertion grooves 122 into which the locking members 18 are inserted are provided at either end in the longitudinal pitch direction, and a required number of insertion grooves 121 into which the contacts 14 are inserted is provided between the insertion grooves 122. The insertion grooves 121, 122, which may be of any shape/size as long as the contacts 14 and the locking members 18 can be inserted/held, are properly designed in consideration of connection stability, holding force on the housing 12, strength, workability, etc.

Further, at either end in the longitudinal pitch direction bearings 127 are provided on which a shaft 162 of the pivoting member 16 is pivotally mounted. The bearings 127, which may be of any shape and size as long as the shaft 162 of the pivoting member 16 can be pivotally mounted, are properly designed in consideration of this role, the strength and size of the housing 12, etc. A certain clearance is provided between the shaft 162 and the bearings 127. In the present embodiment, the clearance is in the range of 0.03 to 0.08 mm.

The housing 12 is provided with the roof portion 125 that covers the contact portions 141 of the contacts 14. The roof portion 125 enhances the dust resistance of the contacts 14. The size and shape thereof are properly designed in consideration of this role, the strength of the housing 12, pivotability and strength of the pivoting member 16, etc. Taking into account the reduction in profile height, the thickness of the housing 12 is realized as thin as possible.

The housing 12 is provided at either end in the longitudinal pitch direction with the grooves 126 for engaging with the engaging portions 202 of the fixtures 20, on the fitting opening 5 side. The grooves 126 are engaged with the engaging portions 202 of the fixtures 20 to complement the housing 12 (roof portion 125) so as to provide a measure against the rocking motion of the FPC 70 in the upward direction. The grooves 126 may be of any shape/size as long as they can be engaged with the engaging portions 202 of the fixtures 20 and the reduction in profile height can be achieved. Depending on the shape/size of the engaging portions 202, the grooves 126 are properly designed in consideration of the measures against rocking motion, the reduction in profile height, strength, workability, etc. Of course, in case the fixture 20 the engaging portions 202 of which are connected and which is therefore formed as one piece is used, the grooves 126 are connected in the longitudinal pitch direction.

The housing 12 is provided with two recess portions designed to achieve a reduction in the profile height of the connector 10: a first recess portion 123 and a second recess portion 124. The first recess portion 123 accommodates the first pressure receiving portions 146 of the contacts 14 and the pressure receiving portions 186 of the locking members 18 when they are raised by the pressing portions 163 of the pivoting member 16; and it also accommodates the pivoting member 16. In the present embodiment, in consideration of strength, workability, etc., all parts that correspond to the contacts 14 and the locking members 18 are cut away.

The second recess portion 124 is provided, on the fitting opening 5 side, on the side opposite from the roof portion 125. The second recess portion 124 accommodates the parts of the contacts 14 from the first fulcrum portions 145 to the first connection portions 143. In the present embodiment, in consideration of strength, workability, etc., all parts that correspond to the contacts 14 are cut away. However, the second recess portion 124 is only required to accommodate the parts of the contacts 14 from the first fulcrum portions 145 to the first connection portions 143. Therefore, the second recess portion 124 may also be realized as slit-shaped recesses for the respective contacts 14.

Finally, the pivoting member 16 is described. The pivoting member 16 is electrically insulating plastic and it is manufactured by a widely known injection molding technique. The material thereof is properly selected in consideration of dimensional stability, workability, cost, etc., and examples thereof typically include polybutylene terephthalate (PBT), polyamides (66PA, 46PA), liquid crystal polymers (LCP), polycarbonates (PC), synthetic materials thereof, etc.

The pivoting member 16 mainly comprises the shaft 162 which is pivotally mounted on the housing 12; the pressing portions 163, 163 for pressing on the first pressure receiving portions 146 of the contacts 14 and the pressure receiving portions 186 of the locking members 18, and the separate individual anchoring holes 164, 164 which are segmented by the partition walls 165 and into which the first pressure receiving portions 146 and the pressure receiving portions 186 are inserted. The shaft 162 is a rotation axis for rotating the pivoting member 16, and the pivoting member 16 is properly pivotally mounted at either end of the housing 12 in the longitudinal pitch direction. The shaft 162, which may be of any shape and size as long as the pivoting member 16 can be pivotally mounted, is properly designed in consideration of this role, the strength and size of the housing 12, etc. A certain clearance is provided between the shaft 162 and the bearings 127. In the present embodiment, the clearance is in the range of 0.03 to 0.08 mm. Further, at either end in the longitudinal pitch direction, locking portions may be provided to engage with the housing 12 so as to prevent the pivoting member 16 from being raised in the height direction (upward direction in the drawings) when the first pressure receiving portions 146 of the contacts 14 are pressed. The locking portions, if provided, may be of any shape, size, and the like as long as they can be engaged with the housing 12, and they are properly designed in consideration of the aforementioned role, the size and strength of the connector, etc.

The pressing portions 163, which press on the first pressure receiving portions 146 of the contacts 14 and on the pressure receiving portions 186 of the locking members 18, are preferably of elongated shape. In the present embodiment, they are of oval shape. Due to the pressing portions 163 having such an oval shape, the first pressure receiving portions 146 of the contacts 14 and the pressure receiving portions 186 of the locking members 18 are raised due to the change in size of the pressing portions 163 when the pressing portions 163 are rotated to act on the first pressure receiving portions 146 of the contacts 14 and the pressure receiving portions 186 of the locking members 18. Then, the first contact portions 141 of the contacts 14 are pressed onto the FPC 70 or FFC, and the engaging portions 181 of the locking members 18 are engaged. The pressing portions 163 may be of any shape as long as they can be rotated to act on the first pressure receiving portions 146 of the contacts 14 and the pressure receiving portion 186 of the locking members 18, and as long as the first pressure receiving portions 146 of the contacts 14 and the pressure receiving portions 186 of the locking members 18 are raised due to a difference in size between the major and the minor axes.

The pivoting member 16 is provided with an operating portion 161 for rotating the pivoting member 16. The operating portion 161 controls the pivoting member 16 upon the insertion/removal of the FPC 70, FFC, or the like. The shape/size of the operating portion 161 is properly designed in consideration of operability, reduction in profile height, strength, workability, etc.

Further, since the repulsion force working against the rotation of the pivoting member 16 is strong during the rotation of the pivoting member 16, the anchoring holes 164 into which the first pressure receiving portions 146 of the contacts 14 and the pressure receiving portions 186 of the locking members 18 are inserted are provided separately and individually by the partition walls 165 being formed. The anchoring holes 164 which are separately and individually provided enhance the strength of the pivoting member 16 and prevent the deformation of the pivoting member 16 during rotation. The aforementioned pivoting member 16 is pivotally mounted on the side of the housing 12 opposite from the fitting opening 5. The anchoring holes 164 and the partition walls 165, which may be of any shape/size as long as the first pressure receiving portions 146 of the contacts 14 and the pressure receiving portions 186 of the locking members 18 can be inserted into the anchoring holes 164, are properly designed in consideration of the enhancement of strength, prevention of deformation during rotation, strength, workability, etc.

Further, the first protruding portions 149 and/or the protruding portions provided at the ends of the first pressure receiving portions 146 of the contacts 14 and/or the pressure receiving portions 186 of the locking members 18 are engaged with the anchoring holes 164 so as to prevent the center part of the pivoting member 16 from bulging due to the strong repulsion force working against the rotation of the pivoting member 16 when the pivoting member 16 is rotated. By providing the anchoring holes 164 separately and individually, the strength of the pivoting member 16 is enhanced and the deformation of the pivoting member 16 during rotation is prevented.

In positions corresponding to the locking members 18, the pivoting member 16 is provided with recesses 166 on the faces that are in contact with the locking members 18 from the fulcrum portions 185 to the connection portions 183. The recesses 166 are provided for the same purpose as the recess portions 148 of the contacts 14. In other words, since the locking members 18 contact the pivoting member 16 with the connection portions 183, the locking members 18 cannot be provided with recesses (accommodations). Instead, the pivoting member 16 is provided with recesses (accommodations). The recesses 166, which accommodate the locking members 18 from the fulcrum portions 185 to the connection portions 183 when the pivoting member 16 is closed, are designed to achieve a reduction in profile height. The shape/size of the recesses 166 is properly designed in consideration of this role, the reduction in profile height, strength, workability, etc. under the condition that the locking members 18 from the fulcrum portions 185 to the connection portions 183 can be accommodated.

Now, the manner of the movement and rotation of the pressing portions 163 of the pivoting member 16 is described with reference to FIGS. 8(A) to 8(E). Specifically, the rotation axes of the pressing portions 163 of the pivoting member 16 are rotated while moving within the clearance between the shaft 162 of the pivoting member 16 and the bearings 127 of the housing 12.

Figure 8A:
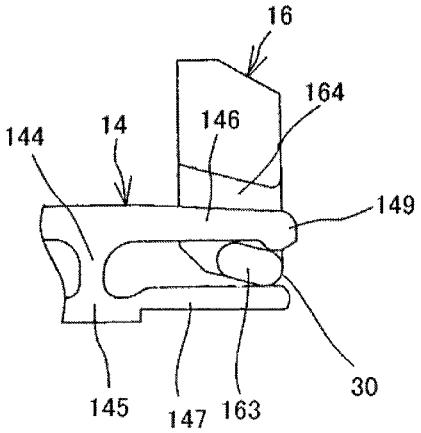
FIGS. 8(A) to (E) are explanatory views of the motions of the pressing portion and the rotation axis during the rotation of the pivoting member.

FIG. 8(A) shows the connector 10 prior to being connected to the connecting object. Here, the lower ends 30 of the pressing portions 163 are positioned between first protruding portions 149 of the first pressure receiving portions 146 and the first extending portions 147.

Figure 8B:
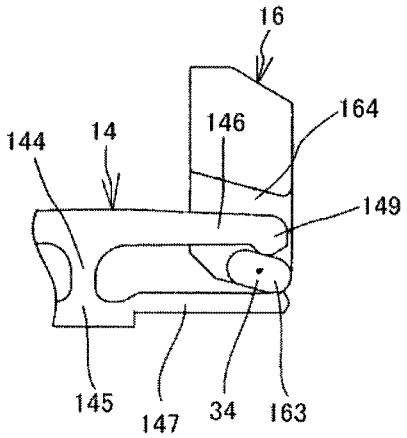

FIG. 8(B) shows that when the operating portion 161 is rotated (in clockwise direction in the drawing), the pressing portions 163 are moved in the direction opposite from the fitting opening 5 so that the lower ends 30 of the pressing portions 163 are sandwiched between the first protruding portions 149 of the first pressure receiving portions 146 and the first extending portions 147.

Figure 8C:
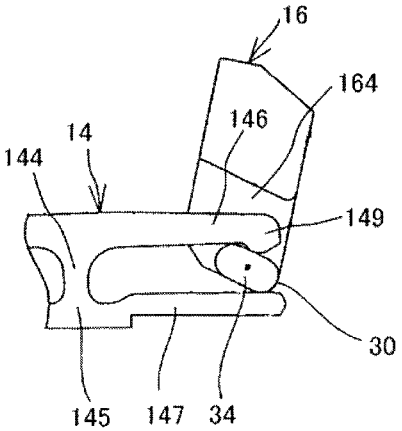

FIG. 8(C) shows that when the operating portion 161 is further rotated, the pressing portions 163 are rotated around their centers as the rotation axis 34 in the position shown in FIG. 8(B).

Figure 8D:
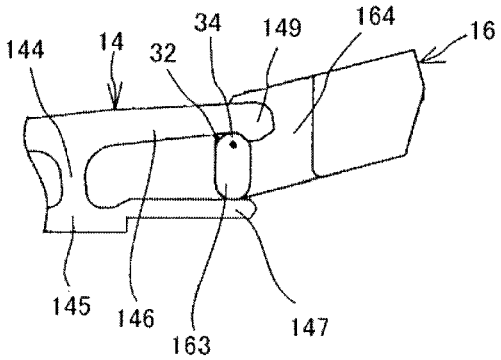

FIG. 8(D) shows that when the operating portion 161 is further rotated, the pressing portions 163 are rotated around their centers as the rotation axis 34 in the position shown in FIG. 8(C) so that the pressing portions 163 are substantially vertical between the first pressure receiving portions 146 and the first extending portions 147 and the rotation axis 34 moves toward the upper ends 32 which have come into contact with the first protruding portions 149.

Figure 8E:
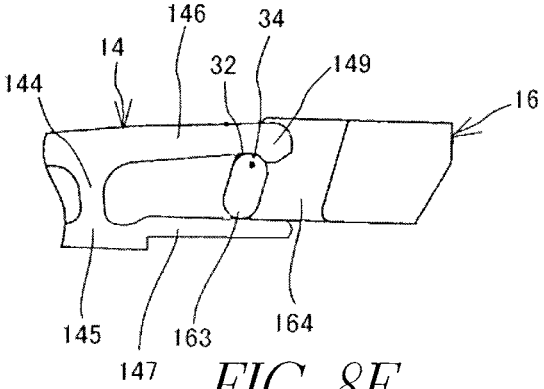
Figure 8F:
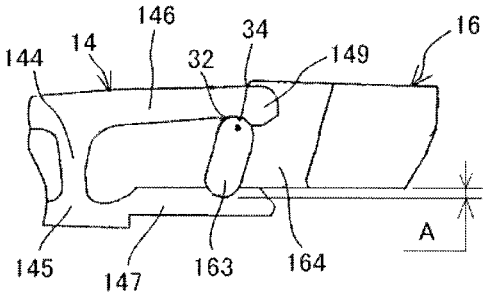
FIG. 8(F) is an explanatory view of the profile-height-reducing effect when the rotation axis (dent) is not provided in the contact.

FIG. 8(E) shows that when the operating portion 161 is further rotated, the pressing portions 163 are rotated around the upper ends 32 which are in contact with the first protruding portions 149 in the position in FIG. (8D) so that the pressing portions 163 are engaged in a state where they are caught by the first protruding portion 149.

Specifically, the pressing portions 163 are first moved, then rotated, and further rotated so that the rotation axis 34 is shifted, and they thus perform a space-saving and compact pivotal movement (rotation).

In comparison to a conventional connector wherein the rotation axis of the pressing portions 163 is provided in the contacts (and wherein it is necessary to make the contacts thicker by the depth of the rotation axis (dent) inside the first extending portions 147), the space-saving and compact pivotal movement (rotation) (the pressing portions 163 are rotated while moving within the clearance between the shaft 162 and the bearings 127) allows a reduction in profile height by the depth of the rotation axis (dent) in the first extending portions 147 and a reduction of the load on the first pressure receiving portion 146. By the reduction in load, the first pressure receiving portions 146 can be improved in durability and reduced in size in the width direction (the extension direction of the connection portion). Simply digging a recess for the pressing portions 163 into the first extending portions 147 weakens the strength of the first extending portions 147, and increasing the thickness of the first extending portions 147 so that the rotation axis 34 can be provided in the contacts reduces the space between the first extending portions 147 and the first pressure receiving portions 146 so that the insertion (mounting) of the pressing portions 163 becomes impossible. In order to secure the space for inserting the pressure receiving portions 163, the thickness of the first extending portions 147, as shown in FIG. 8(F), needs to be increased by a dimension A, and the space between the first extending portions 147 and the first pressure receiving portions 146 needs to be expanded by the dimension A. In other words, by not providing a fixed rotation axis, the height is reduced by the dimension A.

Hereinafter, a connector (not shown) with two types of contacts arranged in an alternating manner is described. It is a connector wherein the above-described contacts 14 are replaced by first contacts and the locking members 18 by second contacts as follows. The first contacts are inserted into the housing 12 from the side of the fitting opening 5 and the second contacts from the side opposite from the fitting opening 5 in an alternating manner. The locking members 18 are replaced by the second contacts, the engaging portions 181 being replaced by second contact portions, the fixing portions 182 by second fixing portions, the connection portions 183 by second connection portions, the elastic portions 184 by second elastic portions, the fulcrum portions 185 by second fulcrum portions, and the pressure receiving portions 186 by second pressure receiving portions. When such second contacts are used, the pivoting member 16 is further provided with recesses in positions corresponding to the second contacts. The second contacts may be further provided with second extending portions extending from the second fulcrum portions in a direction facing the second contact portions. The shape/size of the second contact portions is the same as that of the first contact portions 141.

INDUSTRIAL APPLICABILITY

The present invention relates to a connector used for communication equipment, electric devices, or electronic appliances, such as mobile terminals, projectors, television sets, etc., and it relates particularly to measures against the rocking motion of a connecting object in insertion direction, longitudinal pitch direction or upward direction, which are realized with a simple structure designed to achieve a connector with a flatter profile.

What is claimed is:

1. A connector for detachably plugging a connecting object, comprising:

a plurality of contacts, each having a contact portion for contacting the connecting object, and a pressure receiving portion subjected to action of a pivoting member;

a housing holding and arranging the plurality of contacts and having a fitting opening for inserting the connecting object, wherein the pivoting member is pivotally mounted on a side of the housing opposite from the fitting opening;

a plurality of locking members arranged at either end in a longitudinal pitch direction of the connector, wherein each locking member includes:

an engaging portion for engaging with one of anchoring portions provided by the connecting object, a connection portion for connecting to a board, an elastic portion and a fulcrum portion provided between the engaging portion and the connection portion, and a pressure receiving portion extending from the elastic portion in a direction opposite from that of the engaging portion;

wherein the housing is provided with a first recess portion on an upper side of the housing that allows the pressure receiving portions of both the contacts and the locking members to be moved, and grooves on the upper side of the housing extending from the fitting opening;

wherein the pivoting member is provided with a plurality of second recess portions that recess only part of the way through a face of the pivoting member, wherein the face of the pivoting member is viewable from the opposite side of the fitting opening when the pivoting member is in an open position, and wherein each of the plurality of second recess portions accommodates at least each of the connection portions of the locking members when the pivoting member is in a closed position, and wherein the pivoting member is provided with a plurality of anchoring holes that go through the face of the pivoting member, wherein each of the plurality of anchoring holes accommodates at least each of the pressure receiving portions of the locking members when the pivoting member is in the closed position;

fixtures, each of which has an engaging portion for engaging with one groove each and a connection portion for connecting to the board, are arranged on a side of the housing where the fitting opening is located; and wherein each contact is at least provided with a first elastic portion and a first fulcrum portion provided between a first contact portion, which is the contact portion, and a first connection portion such that the first contact portion, the first elastic portion, the first fulcrum portion and the first connection portion are arranged according to a U-shape configuration and with a first pressure receiving portion, which is the pressure receiving portion, extending from the first elastic portion in the direction opposite from the first contact portion.

2. The connector according to claim 1, wherein each of the plurality of second recess portions accommodates a respective locking member of the locking members.

3. The connector according to claim 1, wherein the locking members provide a measure against rocking motion of the connecting object in an insertion and removal direction.

4. The connector according to claim 1, wherein the engaging portions of the fixtures are engaged with the grooves of the housing to provide a measure against rocking motion of the connecting object in upward and pitch directions.

5. The connector according to claim 1, wherein the first and second recess portions allow a reduction in profile height of the connector.

6. The connector as recited in claim 1, wherein the engaging portion, the elastic portion, the fulcrum portion, the pressure receiving portion, and the connection portion of each locking member are arranged in a transverse h-shape.

7. The connector as recited in claim 1, wherein the engaging portion, the elastic portion, the fulcrum portion and the connection portion of each locking member are inserted into the housing on a side opposite from the fitting opening.

8. The connector as recited in claim 1, wherein the connection portions of the fixtures are arranged on the side of the housing where the fitting opening is located.

9. The connector as recited in claim 8, wherein the connection portions of the locking members and the connection portions of the fixtures are arranged on opposite side of each other.

10. The connector as recited in claim 1, wherein second contacts are inserted into the housing from the side opposite from the fitting opening, wherein the contacts and the second contacts are arranged in an alternating manner, and wherein each of the second contacts is provided with:

a second elastic portion, a second fulcrum portion provided between a second contact portion, which is the contact portion, and a second connection portion, and a second pressure receiving portion, which is the pressure receiving portion, extending from the second elastic portion in a position opposite the second connection portion, such that the second contact portion, the second elastic portion, the second pressure receiving portion, the second fulcrum portion, and the second connection portion are arranged in a transverse h-shape.

11. The connector as recited in claim 1, wherein, when the connecting object is inserted into the fitting opening, the connecting object is inserted into the fitting opening in such a manner as to abut against the first connection portions of the contacts.

12. The connector as recited in claim 1, wherein the pivoting member is pivotally mounted on a side of the housing opposite from the fitting opening and provided with elongated pressing portions which are longitudinally provided parallel to the pivoting member such that individual pressing portions act on the pressure receiving portion of a respective contact of the plurality of contacts or the pressure receiving portion of a respective locking member of the locking members.

13. The connector as recited in claim 12, wherein the pivoting member is further provided with separate individual anchoring holes with partition walls into each of which one of the pressure receiving portions of the plurality of contacts or one of the pressure receiving portions of the locking members is inserted such that when the pressing portion acts on the pressure receiving portion of at least one contact or the pressure receiving portion of at least one locking member, a connection and engagement with the connecting object is made.

14. The connector as recited in claim 1, wherein each extending portion of the contacts is provided with a recess that accommodates a thickness of the housing.

15. A connector for detachably plugging a connecting object, comprising:

a plurality of contacts, each having a contact portion for contacting the connecting object, and a pressure receiving portion subjected to action of a pivoting member;

a housing holding and arranging the contacts and having a fitting opening for inserting the connecting object, wherein the pivoting member is pivotally mounted on a side of the housing opposite from the fitting opening; and locking means having an engaging portion for engaging with at least one anchoring portion provided by the connecting object, a connection portion for connecting to a board, an elastic portion and a fulcrum portion provided between the engaging portion and the connection portion, and a pressure receiving portion subjected to action of the pivoting member and extending from the elastic portion in a direction opposite from that of the engaging portion;

wherein the pivoting member includes at least one recess portion that recesses only part of the way through a face of the pivoting member, wherein the face of the pivoting member is viewable from the opposite side of the fitting opening when the pivoting member is in an open position, and wherein the at least one recess portion accommodates at least each of the connection portions of the locking means when the pivoting member is in a closed position;

wherein the pivoting member includes at least one anchoring hole that goes through the face of the pivoting member, and wherein the at least one anchoring hole accommodates at least each of the pressure receiving portions of the locking means when the pivoting member is in the closed position; and wherein each contact is at least provided with a first elastic portion and a first fulcrum portion provided between a first contact portion, which is the contact portion, and a first connection portion such that the first contact portion, the first elastic portion, the first fulcrum portion and the first connection portion are arranged roughly in a U-shape and with a first pressure receiving portion, which is the pressure receiving portion, extending from the first elastic portion in the direction opposite from the first contact portion.

* * * * *